US008808412B2

(12) United States Patent
Klett et al.

(10) Patent No.: US 8,808,412 B2
(45) Date of Patent: Aug. 19, 2014

(54) MICROFIBER REINFORCEMENT FOR ABRASIVE TOOLS

(75) Inventors: Michael W. Klett, Holden, MA (US); Karen Conley, Amesbury, MA (US); Steven F. Parsons, Worcester, MA (US); Han Zhang, Shrewsbury, MA (US); Arup K. Khaund, Northborough, MA (US)

(73) Assignees: Saint-Gobain Abrasives, Inc., Worcester, MA (US); Saint-Gobain Abrasifs, Conflans-Sainte-Honorine (FR)

( * ) Notice: Subject to any disclaimer, the term of this patent is extended or adjusted under 35 U.S.C. 154(b) by 0 days.

(21) Appl. No.: 11/895,641

(22) Filed: Aug. 24, 2007

(65) Prior Publication Data

US 2008/0072500 A1 Mar. 27, 2008

Related U.S. Application Data

(60) Provisional application No. 60/844,862, filed on Sep. 15, 2006.

(51) Int. Cl.

| | |
|---|---|
| ***B24D 11/00*** | (2006.01) |
| ***B24B 1/00*** | (2006.01) |
| ***B24D 7/04*** | (2006.01) |
| ***B24D 3/34*** | (2006.01) |

(52) U.S. Cl.

CPC *B24D 3/342* (2013.01); *B24D 7/04* (2013.01); *B24D 11/00* (2013.01)

USPC ..... 51/295; 51/298; 51/307

(58) Field of Classification Search

USPC ..... 51/298, 307, 308, 309; 451/540

See application file for complete search history.

(56) References Cited

U.S. PATENT DOCUMENTS

| | | | |
|---|---|---|---|
| 2,527,628 | A | 10/1950 | Francis, Jr. |
| 2,711,365 | A | 6/1955 | Price et al. |

(Continued)

FOREIGN PATENT DOCUMENTS

| | | | |
|---|---|---|---|
| AR | 012763 | A1 | 11/2000 |
| EP | 0000840 | A1 | 2/1979 |

(Continued)

OTHER PUBLICATIONS

International Search Report and Written Opinion from International Application No. PCT/US2007/078486, filed Sep. 14, 2007, mailed on Jan. 25, 2008.

(Continued)

*Primary Examiner* — Kaj K Olsen
*Assistant Examiner* — Ross J Christie
(74) *Attorney, Agent, or Firm* — Abel Law Group, LLP; Joseph P. Sullivan

(57) ABSTRACT

A composition that can be used for abrasive processing is disclosed. The composition includes an organic bond material, an abrasive material dispersed in the organic bond material, and a plurality of microfibers uniformly dispersed in the organic bond material. The microfibers are individual filaments having an average length of less than about 1000 μm. Abrasive articles made with the composition exhibit improved strength and impact resistance relative to non-reinforced abrasive tools, and improved wheel wear rate and G-ratio relative to conventional reinforced tools. Active fillers that interact with microfibers may be used to further abrasive process benefits.

16 Claims, 1 Drawing Sheet

(56) References Cited

U.S. PATENT DOCUMENTS

| | | | | |
|---|---|---|---|---|
| 2,800,403 | A | 7/1957 | Bosler et al. | |
| 3,524,286 | A * | 8/1970 | Wohrer | 51/298 |
| 3,590,472 | A | 7/1971 | Nix et al. | |
| 3,762,894 | A | 10/1973 | Holzhauer | |
| 3,902,864 | A | 9/1975 | Nix et al. | |
| 4,072,650 | A | 2/1978 | Littlefield | |
| 4,364,746 | A | 12/1982 | Bitzer et al. | |
| 4,384,054 | A | 5/1983 | Moraw et al. | |
| 4,500,325 | A * | 2/1985 | Huber et al. | 51/298 |
| 4,595,638 | A | 6/1986 | Dohnomoto et al. | |
| 4,601,956 | A | 7/1986 | Dohnomoto | |
| 4,678,818 | A | 7/1987 | Nakagawa et al. | |
| 4,743,635 | A | 5/1988 | Nakagawa et al. | |
| 4,784,918 | A | 11/1988 | Klett | |
| 4,799,939 | A * | 1/1989 | Bloecher et al. | 51/293 |
| 4,806,620 | A | 2/1989 | Klett | |
| 4,900,857 | A | 2/1990 | Klett | |
| 4,992,488 | A | 2/1991 | Ruf | |
| 5,035,724 | A | 7/1991 | Pukari et al. | |
| 5,043,303 | A | 8/1991 | Singh et al. | |
| 5,061,295 | A * | 10/1991 | Hickory et al. | 51/298 |
| 5,219,656 | A | 6/1993 | Klett | |
| 5,242,958 | A | 9/1993 | Klett | |
| 5,604,270 | A | 2/1997 | Klett | |
| 5,605,757 | A | 2/1997 | Klett | |
| 6,126,533 | A * | 10/2000 | Johnson et al. | 451/527 |
| 6,261,156 | B1 * | 7/2001 | Johnson et al. | 451/41 |
| 6,413,287 | B1 * | 7/2002 | Barber, Jr. | 51/298 |
| 6,475,253 | B2 * | 11/2002 | Culler et al. | 51/295 |
| 6,534,565 | B1 | 3/2003 | Gardner et al. | |
| 6,609,964 | B1 * | 8/2003 | Avril et al. | 451/546 |
| 6,656,240 | B2 | 12/2003 | Chiba | |
| 7,141,086 | B2 * | 11/2006 | Endoh et al. | 51/307 |
| 7,306,665 | B2 | 12/2007 | Nagayoshi et al. | |
| 7,399,330 | B2 | 7/2008 | Schwabel et al. | |
| 2003/0039932 | A1 * | 2/2003 | Campbell et al. | 431/2 |
| 2003/0154882 | A1 | 8/2003 | Nagata et al. | |
| 2004/0146702 | A1 | 7/2004 | Shao et al. | |
| 2005/0221061 | A1 | 10/2005 | Toas | |
| 2007/0084133 | A1 | 4/2007 | Schwabel et al. | |
| 2008/0004404 | A1 | 1/2008 | van de Grampel et al. | |
| 2008/0072500 | A1 | 3/2008 | Klett et al. | |
| 2008/0236051 | A1 | 10/2008 | Schwabel et al. | |
| 2010/0162632 | A1 | 7/2010 | Zuyev et al. | |
| 2010/0190424 | A1 | 7/2010 | Francois et al. | |

FOREIGN PATENT DOCUMENTS

| | | | |
|---|---|---|---|
| EP | 0271965 | A2 | 6/1988 |
| EP | 0344610 | A2 | 12/1989 |
| GB | 406921 | | 3/1934 |
| JP | 57208323 | | 12/1982 |
| JP | 58211035 | | 12/1983 |
| JP | 59080539 | | 5/1984 |
| JP | 60106847 | | 6/1985 |
| JP | 11106523 | | 4/1999 |
| JP | 2003311630 | | 11/2003 |
| JP | 2006-249206 | | 9/2006 |
| JP | 2006-257114 | | 9/2006 |
| WO | 97/27983 | A1 | 8/1997 |
| WO | 98/10895 | A1 | 3/1998 |
| WO | 98/10896 | A1 | 3/1998 |
| WO | WO 2005/120812 | A1 | 12/2005 |

OTHER PUBLICATIONS

International Preliminary Report on Patentability dated Mar. 17, 2009, from counterpart International Application PCT/US2007/078486.

* cited by examiner

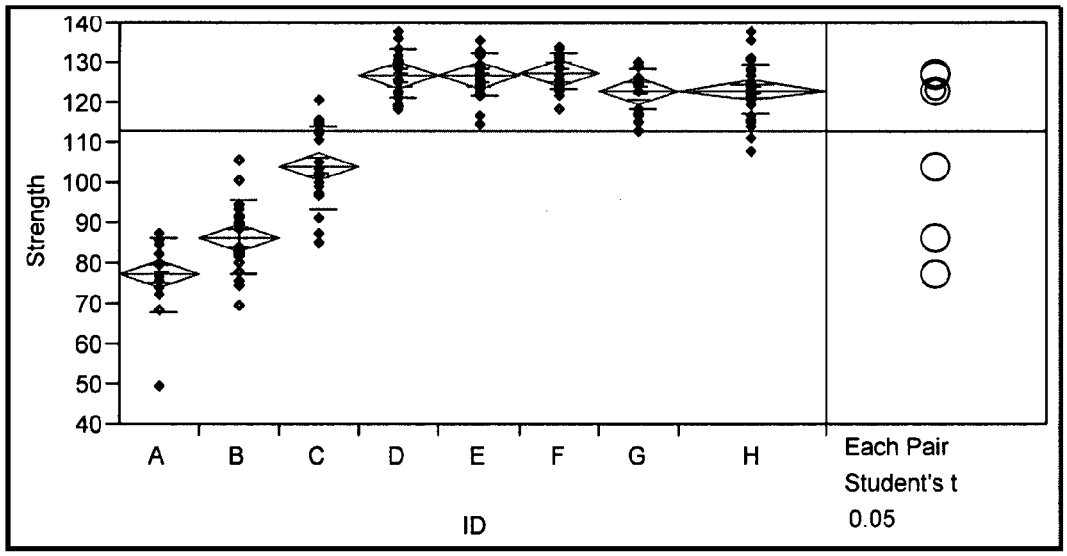
140
130
120
110
100
90
80
70
60
50
40
Strength
A
B
C
D
E
F
G
H
ID
Each Pair
Student's t
0.05

MICROFIBER REINFORCEMENT FOR ABRASIVE TOOLS

RELATED APPLICATION(S)

This application claims the benefit of U.S. Provisional Application No. 60/844,862, filed on Sep. 15, 2006.

The entire teachings of the above application(s) are incorporated herein by reference.

BACKGROUND OF THE INVENTION

Chopped strand fibers are used in dense resin-based grinding wheels to increase strength and impact resistance. The chopped strand fibers typically 3-4 mm in length, are a plurality of filaments. The number of filaments can vary depending on the manufacturing process but typically consists of 400 to 6000 filaments per bundle. The filaments are held together by an adhesive known as a sizing, binder, or coating that should ultimately be compatible with the resin matrix. One example of a chopped strand fiber is referred to as 183 Cratec®, available from Owens Corning.

Incorporation of chopped strand fibers into a dry grinding wheel mix is generally accomplished by blending the chopped strand fibers, resin, fillers, and abrasive grain for a specified time and then molding, curing, or otherwise processing the mix into a finished grinding wheel.

In any such cases, chopped strand fiber reinforced wheels typically suffer from a number of problems, including poor grinding performance as well as inadequate wheel life.

There is a need, therefore, for improved reinforcement techniques for abrasive processing tools.

SUMMARY OF THE INVENTION

One embodiment of the present invention provides a composition, comprising an organic bond material (e.g., thermosetting resin, thermoplastic resin, or rubber), an abrasive material dispersed in the organic bond material, and microfibers uniformly dispersed in the organic bond material. The microfibers are individual filaments and may include, for example, mineral wool fibers, slag wool fibers, rock wool fibers, stone wool fibers, glass fibers, ceramic fibers, carbon fibers, aramid fibers, and polyamide fibers, and combinations thereof. The microfibers have an average length, for example, of less than about 1000 μm. In one particular case, the microfibers have an average length in the range of about 100 to 500 μm and a diameter less than about 10 microns. The composition may further include one or more active fillers. These fillers may react with the microfibers to provide various abrasive process benefits (e.g., improved wheel life, higher G-ratio, and/or anti-loading of abrasive tool face). In one such case, the one or more active fillers are selected from manganese compounds, silver compounds, boron compounds, phosphorous compounds, copper compounds, iron compounds, zinc compounds, and combinations thereof. In one specific such case, the one or more active fillers includes manganese dichloride. The composition may include, for example, from 10% by volume to 50% by volume of the organic bond material, from 30% by volume to 65% by volume of the abrasive material, and from 1% by volume to 20% by volume of the microfibers. In another particular case, the composition includes from 25% by volume to 40% by volume of the organic bond material, from 50% by volume to 60% by volume of the abrasive material, and from 2% by volume to 10% by volume of the microfibers. In another particular case, the composition includes from 30% by volume to 40% by volume of the organic bond material, from 50% by volume to 60% by volume of the abrasive material, and from 3% by volume to 8% by volume of the microfibers. In another embodiment, the composition is in the form of an abrasive article used in abrasive processing of a workpiece. In one such case, the abrasive article is a wheel or other suitable form for abrasive processing.

Another embodiment of the present invention provides a method of abrasive processing a workpiece. The method includes mounting the workpiece onto a machine capable of facilitating abrasive processing, and operatively coupling an abrasive article to the machine. The abrasive article includes an organic bond material, an abrasive material dispersed in the organic bond material, and a plurality of microfibers uniformly dispersed in the organic bond material, wherein the microfibers are individual filaments having an average length of less than about 1000 μm. The method continues with contacting the abrasive article to a surface of the workpiece.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

BRIEF DESCRIPTION OF THE DRAWINGS

The FIGURE is a plot representing the strength analysis of compositions configured in accordance with various embodiments of the present invention.

DETAILED DESCRIPTION OF THE INVENTION

As previously mentioned, chopped strand fibers can be used in dense resin-based grinding wheels to increase strength and impact resistance, where the incorporation of chopped strand fibers into a dry grinding wheel mix is generally accomplished by blending the chopped strand fibers, resin, fillers, and abrasive grain for a specified time. However, the blending or mixing time plays a significant role in achieving a useable mix quality. Inadequate mixing results in non-uniform mixes making mold filling and spreading difficult and leads to non-homogeneous composites with lower properties and high variability. On the other hand, excessive mixing leads to formation of "fuzz balls" (clusters of multiple chopped strand fibers) that cannot be re-dispersed into the mix. Moreover, the chopped strand itself is effectively a bundle of filaments bonded together. In either case, such clusters or bundles effectively decrease the homogeneity of the grinding mix and make it more difficult to transfer and spread into a mold. Furthermore, the presence of such clusters or bundles within the composite decreases composite properties such as strength and modulus and increases property variability. Additionally, high concentrations of glass such as chopped strand or clusters thereof have a deleterious affect on grinding wheel life. In addition, increasing the level of chopped strand fibers in the wheel can also lower the grinding performance (e.g., as measured by G-Ratio and/or WWR).

In one particular embodiment of the present invention, producing microfiber-reinforced composites involves complete dispersal of individual filaments within a dry blend of suitable bond material (e.g., organic resins) and fillers. Complete dispersal can be defined, for example, by the maximum composite properties (such as strength) after molding and curing of an adequately blended/mixed combination of microfibers, bond material, and fillers. For instance, poor mixing results in low strengths but good mixing results in high strengths. Another way to assess the dispersion is by isolating and weighing the undispersed (e.g., material that resembles the original microfiber before mixing) using sieving techniques. In practice, dispersion of the microfiber reinforcements can be assessed via visual inspection (e.g., with or without microscope) of the mix before molding and curing. As will be apparent in light of this disclosure, incomplete or otherwise inadequate microfiber dispersion generally results in lower composite properties and grinding performance.

In accordance with various embodiments of the present invention, microfibers are small and short individual filaments having high tensile modulus, and can be either inorganic or organic. Examples of microfibers are mineral wool fibers (also known as slag or rock wool fibers), glass fibers, ceramic fibers, carbon fibers, aramid or pulped aramid fibers, polyamide or aromatic polyamide fibers. One particular embodiment of the present invention uses a microfiber that is an inorganic individual filament with a length less than about 1000 microns and a diameter less than about 10 microns. In addition, this example microfiber has a high melting or decomposition temperature (e.g., over 800° C.), a tensile modulus greater than about 50 GPa, and has no or very little adhesive coating. The microfiber is also highly dispersible as discrete filaments, and resistant to fiber bundle formation. Additionally, the microfibers should chemically bond to the bond material being used (e.g., organic resin). In contrast, a chopped strand fiber and its variations includes a plurality of filaments held together by adhesive, and thereby suffers from the various problems associated with fiber clusters (e.g., fuzz balls) and bundles as previously discussed. However, some chopped strand fibers can be milled or otherwise broken-down into discrete filaments, and such filaments can be used as microfiber in accordance with an embodiment of the present invention as well. In some such cases, the resulting filaments may be significantly weakened by the milling/break-down process (e.g., due to heating processes required to remove the adhesive or bond holding the filaments together in the chopped strand or bundle). Thus, the type of microfiber used in the bond composition will depend on the application at hand and desired strength qualities.

In one such embodiment, microfibers suitable for use in the present invention are mineral wool fibers such as those available from Sloss Industries Corporation, AL, and sold under the name of PMF®. Similar mineral wool fibers are available from Fibertech Inc, MA, under the product designation of Mineral wool FLM. Fibertech also sells glass fibers (e.g., Microglass 9110 and Microglass 9132). These glass fibers, as well as other naturally occurring or synthetic mineral fibers or vitreous individual filament fibers, such as stone wool, glass, and ceramic fibers having similar attributes can be used as well. Mineral wool generally includes fibers made from minerals or metal oxides. An example composition and set of properties for a microfiber that can be used in the bond of a reinforced grinding tool, in accordance with one embodiment of the present invention, are summarized in Tables 1 and 2, respectively. Numerous other microfiber compositions and properties sets will be apparent in light of this disclosure, and the present invention is not intended to be limited to any particular one or subset.

TABLE 2

Physical Properties of Sloss PMF ® Fibers

| | | |
|---|---|---|
| Hardness | 7.0 | mohs |
| Fiber Diameters | 4-6 | microns average |
| Fiber Length | 0.1-4.0 | mm average |
| Fiber Tensile Strength | 506,000 | psi |
| Specific Gravity | 2.6 | |
| Melting Point | 1260° | C. |
| Devitrification Temp | 815.5° | C. |
| Expansion Coefficient | 54.7E−7° | C. |
| Anneal Point | 638° | C. |
| Strain Point | 612° | C. |

TABLE 1

Composition of Sloss PMF ® Fibers

| Oxides | Weight % |
|---|---|
| $SiO_2$ | 34-52 |
| $Al_2O_3$ | 5-15 |
| CaO | 20-23 |
| MgO | 4-14 |
| $Na_2O$ | 0-1 |
| $K_2O$ | 0-2 |
| $TiO_2$ | 0-1 |
| $Fe_2O_3$ | 0-2 |
| Other | 0-7 |

Bond materials that can be used in the bond of grinding tools configured in accordance with an embodiment of the present invention include organic resins such as epoxy, polyester, phenolic, and cyanate ester resins, and other suitable thermosetting or thermoplastic resins. In one particular embodiment, polyphenolic resins are used (e.g., such as Novolac resins). Specific examples of resins that can be used include the following: the resins sold by Durez Corporation, TX, under the following catalog/product numbers: 29722, 29344, and 29717; the resins sold by Dynea Oy, Finland, under the trade name Peracit® and available under the catalog/product numbers 8522G, 8723G, and 8680G; and the resins sold by Hexion Specialty Chemicals, OH, under the trade name Rutaphen® and available under the catalog/product numbers 9507P, 8686SP, and 8431SP. Numerous other suitable bond materials will be apparent in light of this disclosure (e.g., rubber), and the present invention is not intended to be limited to any particular one or subset.

Abrasive materials that can be used to produce grinding tools configured in accordance with embodiments of the present invention include commercially available materials, such as alumina (e.g., extruded bauxite, sintered and sol gel sintered alumina, fused alumina), silicon carbide, and alumina-zirconia grains. Superabrasive grains such as diamond and cubic boron nitride (cBN) may also be used depending on the given application. In one particular embodiment, the abrasive particles have a Knoop hardness of between 1600 and 2500 kg/mm$^2$ and have a size between about 50 microns and 3000 microns, or even more specifically, between about 500 microns to about 2000 microns. In one such case, the composition from which grinding tools are made comprises greater than or equal to about 50% by weight of abrasive material.

The composition may further include one or more reactive fillers (also referred to as "active fillers"). Examples of active fillers suitable for use in various embodiments of the present invention include manganese compounds, silver compounds, boron compounds, phosphorous compounds, copper compounds, iron compounds, and zinc compounds. Specific examples of suitable active fillers include potassium aluminum fluoride, potassium fluoroborate, sodium aluminum fluoride (e.g., Cyrolite®), calcium fluoride, potassium chloride, manganese dichloride, iron sulfide, zinc sulfide, potassium sulfate, calcium oxide, magnesium oxide, zinc oxide, calcium phosphate, calcium polyphosphate, and zinc borate. Numerous compounds suitable for use as active fillers will be apparent in light of this disclosure (e.g., metal salts, oxides, and halides). The active fillers act as dispersing aides for the microfibers and may react with the microfibers to produce desirable benefits. Such benefits stemming from reactions of select active fillers with the microfibers generally include, for example, increased thermo-stability of microfibers, as well as better wheel life and/or G-Ratio. In addition, reactions between the fibers and active fillers beneficially provide anti-metal loading on the wheel face in abrasive applications. Various other benefits resulting from synergistic interaction between the microfibers and fillers will be apparent in light of this disclosure.

Thus, an abrasive article composition that includes a mixture of glass fibers and active fillers is provided. Benefits of the composition include, for example, grinding performance improvement for rough grinding applications. Grinding tools fabricated with the composition have high strength relative to non-reinforced or conventionally reinforced tools, and high softening temperature (e.g., above 1000° C.) to improve the thermal stability of the matrix. In addition, a reduction of the coefficient of thermal expansion of the matrix relative to conventional tools is provided, resulting in better thermal shock resistance. Furthermore, the interaction between the fibers and the active fillers allows for a change in the crystallization behavior of the active fillers, which results in better performance of the tool.

A number of examples of microfiber reinforced abrasive composites are now provided to further demonstrate features and benefits of an abrasive tool composite configured in accordance with embodiments of the present invention. In particular, Example 1 demonstrates composite properties bond bars and mix bars with and without mineral wool; Example 2 demonstrates composite properties as a function of mix quality; Example 3 demonstrates grinding performance data as a function of mix quality; and Example 4 demonstrates grinding performance as a function of active fillers with and without mineral wool.

Example 1

Example 1, which includes Tables 3, 4, and 5, demonstrates properties of bond bars and composite bars with and without mineral wool fibers. Note that the bond bars contain no grinding agent, whereas the composite bars include a grinding agent and reflect a grinding wheel composition. As can be seen in Table 3, components of eight sample bond compositions are provided (in volume percent, or vol %). Some of the bond samples include no reinforcement (sample #s 1 and 5), some include milled glass fibers or chopped strand fibers (sample #s 3, 4, 7, and 8), and some include Sloss PMF® mineral wool (sample #s 2 and 6) in accordance with one embodiment of the present invention. Other types of individual filament fibers (e.g., ceramic or glass fiber) may be used as well, as will be apparent in light of this disclosure. Note that the brown fused alumina (220 grit) in the bond is used as a filler in these bond samples, but may also operate as a secondary abrasive (primary abrasive may be, for example, extruded bauxite, 16 grit). Further note that Saran™ 506 is a polyvinylidene chloride bonding agent produced by Dow Chemical Company, the brown fused alumina was obtained from Washington Mills.

TABLE 3

Example Bonds with and without Mineral Wool

| | Samples | | | | | | | |
|---|---|---|---|---|---|---|---|---|
| Components | #1 | #2 | #3 | #4 | #5 | #6 | #7 | #8 |
| Durez 29722 | 48.11 | 48.11 | 48.11 | 48.11 | 42.09 | 42.09 | 42.09 | 42.09 |
| Saran 506 | 2.53 | 2.53 | 2.53 | 2.53 | 2.22 | 2.22 | 2.22 | 2.22 |
| Brown Fused Alumina - 220 Grit | 12.66 | 6.33 | 6.33 | 6.33 | 18.99 | 9.50 | 9.50 | 9.50 |
| Sloss PMF ® | | 6.33 | | | | 9.50 | | |
| Milled Glass Fiber | | | 6.33 | | | | 9.50 | |
| Chopped Strand | | | | 6.33 | | | | 9.50 |
| Iron Pyrite | 20.4 | 20.4 | 20.4 | 20.4 | 20.4 | 20.4 | 20.4 | 20.4 |
| Potassium Chloride/ Sulfate (60:40 blend) | 9.8 | 9.8 | 9.8 | 9.8 | 9.8 | 9.8 | 9.8 | 9.8 |
| Lime | 6.5 | 6.5 | 6.5 | 6.5 | 6.5 | 6.5 | 6.5 | 6.5 |

For the set of sample bonds 1 through 4 of Table 3, the compositions are equivalent except for the type of reinforcement used. In samples 1 and 5 where there is no reinforcement, the vol % of filler (in this case, brown fused alumina) was increased accordingly. Likewise, for the set of samples 5 through 8 of Table 3, the compositions are equivalent except for the type of reinforcement used.

Table 4 demonstrates properties of the bond bar (no abrasive agent), including stress and elastic modulus (E-Mod) for each of the eight samples of Table 3.

TABLE 4

Bond Bar Properties (3-point bend)

| | Samples | | | | | | | |
|---|---|---|---|---|---|---|---|---|
| | #1 | #2 | #3 | #4 | #5 | #6 | #7 | #8 |
| Stress (MPa) | 90.1 | 115.3 | 89.4 | 74.8 | 103.8 | 118.4 | 97 | 80.7 |
| Std Dev (MPa) | 8.4 | 8.3 | 8.6 | 17 | 8 | 6.5 | 8.6 | 10.8 |
| E-Mod (MPa) | 17831 | 17784 | 17197 | 16686 | 21549 | 19574 | 19191 | 19131 |
| Std Dev (MPa) | 1032 | 594 | 1104 | 1360 | 2113 | 1301 | 851 | 1242 |

Table 5 demonstrates properties of the composite bar (which includes the bonds of Table 3 plus an abrasive, such as extruded bauxite), including stress and elastic modulus (E-Mod) for each of the eight samples of Table 3. As can be seen in each of Tables 4 and 5, the bond/composite reinforced with mineral wool (samples 2 and 6) has greater strength relative to the other samples shown.

TABLE 5

| Composite Bar Properties (3-point bend) | | | | | | | | |
|---|---|---|---|---|---|---|---|---|
| | Samples | | | | | | | |
| | #1 | #2 | #3 | #4 | #5 | #6 | #7 | #8 |
| Stress (MPa) | 59.7 | 66.4 | 61.1 | 63.7 | 50.1 | 58.2 | 34 | 34 |
| Std Dev (MPa) | 8.1 | 10.2 | 8.5 | 7.2 | 9.8 | 4.6 | 4.4 | 4.1 |
| E-Mod (MPa) | 6100 | 6236 | 6145 | 6199 | 5474 | 5544 | 4718 | 4427 |
| Std Dev (MPa) | 480 | 424 | 429 | 349 | 560 | 183 | 325 | 348 |

In each of the abrasive composite samples 1 through 8, about 44 vol % is bond (including the bond components noted, less the abrasive), and about 56 vol % is abrasive (e.g., extruded bauxite, or other suitable abrasive grain). In addition, a small but sufficient amount of furfural (about 1 vol % or less of total abrasive) was used to wet the abrasive particles. The sample compositions 1 through 8 were blended with furfural-wetted abrasive grains aged for 2 hours before molding. Each mixture was pre-weighed then transferred into a 3-cavity mold (26 mm×102.5 mm) (1.5 mm×114.5 mm) and hot-pressed at 160° C. for 45 minutes under 140 kg/cm$^2$, then followed by 18 hours of curing in a convection oven at 200° C. The resulting composite bars were tested in three point flexural (5:1 span to depth ratio) using ASTM procedure D790-03.

Example 2

Example 2, which includes Tables 6, 7, and 8, demonstrates composite properties as a function of mix quality. As can be seen in Table 6, components of eight sample compositions are provided (in vol %). Sample A includes no reinforcement, and samples B through H include Sloss PMF® mineral wool in accordance with one embodiment of the present invention. Other types of single filament microfiber (e.g., ceramic or glass fiber) may be used as well, as previously described. The bond material of sample A includes silicon carbide (220 grit) as a filler, and the bonds of samples B through H use brown fused alumina (220 grit) as a filler. As previously noted, such fillers assist with dispersal and may also operate as secondary abrasives. In each of samples A through H, the primary abrasive used is a combination of brown fused alumina 60 grit and 80 grit. Note that a single primary abrasive grit can be mixed with the bond as well, and may vary in grit size (e.g., 6 grit to 220 grit), depending on factors such as the desired removal rates and surface finish.

TABLE 6

| Example Composites with and without Mineral Wool | | | | | | | | |
|---|---|---|---|---|---|---|---|---|
| | Samples | | | | | | | |
| Components | A | B | C | D | E | F | G | H |
| Durez 29722 | 17.77 | 16.88 | 16.88 | 16.88 | 16.88 | 16.88 | 16.88 | 16.88 |
| Saran 506 | 1.69 | 1.57 | 1.57 | 1.57 | 1.57 | 1.57 | 1.57 | 1.57 |
| Silicon Carbide - 220 Grit | 5.92 | 0.00 | 0.00 | 0.00 | 0.00 | 0.00 | 0.00 | 0.00 |
| Brown Fused Alumina - 220 Grit | 0.00 | 3.98 | 3.98 | 3.98 | 3.98 | 3.98 | 3.98 | 3.98 |
| Sloss PMF ® | 0.00 | 3.81 | 3.81 | 3.81 | 3.81 | 3.81 | 3.81 | 3.81 |
| Iron Pyrite | 10.15 | 9.64 | 9.64 | 9.64 | 9.64 | 9.64 | 9.64 | 9.64 |
| Potassium Sulfate | 4.23 | 4.02 | 4.02 | 4.02 | 4.02 | 4.02 | 4.02 | 4.02 |
| Lime | 2.54 | 2.41 | 2.41 | 2.41 | 2.41 | 2.41 | 2.41 | 2.41 |
| Brown Fused Alumina - 60 Grit | 28.5 | 28.5 | 28.5 | 28.5 | 28.5 | 28.5 | 28.5 | 28.5 |
| Brown Fused Alumina - 80 Grit | 28.5 | 28.5 | 28.5 | 28.5 | 28.5 | 28.5 | 28.5 | 28.5 |
| Furfural | ~1 wt % or less of total abrasive | | | | | | | |

As can be seen, samples B through H are equivalent in composition. In sample A where there is no reinforcement, the vol % of other bond components is increased accordingly as shown.

TABLE 7

| Composite Properties as a Function of Mixing Procedures | | | | | | | | |
|---|---|---|---|---|---|---|---|---|
| | Samples | | | | | | | |
| | A | B | C | D | E | F | G | H |
| Mixing Method | Hobart with Paddle | Hobart with Paddle | Hobart with Wisk | Hobart w/Paddle & Interlator @6500 rpm | Eirich | Interlator @3500 rpm | Interlator @6500 rpm | Eirich & Interlator @3500 rpm |
| Mix Time | 30 minutes | 30 minutes | 30 minutes | 30 minutes | 15 minutes | N/A | N/A | 15 minutes |
| Un-dispersed mineral wool | N/A | 0.9 g | 0.6 g | 0 | 0.5 | 0 | 0 | 0 |

Table 7 indicates mixing procedures used for each of the samples. Samples A and B were each mixed for 30 minutes with a Hobart-type mixer using paddles. Sample C was mixed for 30 minutes with a Hobart-type mixer using a wisk. Sample D was mixed for 30 minutes with a Hobart-type mixer using a paddle, and then processed through an Interlator (or other suitable hammermill apparatus) at 6500 rpm. Sample E was mixed for 15 minutes with an Eirich-type mixer. Sample F was processed through an Interlator at 3500 rpm. Sample G was processed through an Interlator at 6500 rpm. Sample H was mixed for 15 minutes with an Eirich-type mixer, and then processed through an Interlator at 3500 rpm. A dispersion test was used to gauge the amount of undispersed mineral wool for each of samples B through H. The dispersion test was as follows: amount of residue resulting after 100 grams of mix was shaken for one minute using the Rototap method followed by screening through a #20 sieve. As can be seen, sample B was observed to have a 0.9 gram residue of mineral wool left on the screen of the sieve, sample C a 0.6 gram residue, and sample E a 0.5 gram residue. Each of samples D, F, G, and H had no significant residual fiber left on the sieve screen. Thus, depending on the desired dispersion of mineral wool, various mixing techniques can be utilized.

The sample compositions A through H were blended with furfural-wetted abrasive grains aged for 2 hours before molding. Each mixture was pre-weighed then transferred into a 3-cavity mold (26 mm×102.5 mm) (1.5 mm×114.5 mm) and hot pressed at 160° C. for 45 minutes under 140 kg/cm$^2$, then followed by 18 hours of curing in a convection oven at 200° C. The resulting composite bars were tested in three point flexural (5:1 span to depth ratio) using ASTM procedure D790-03.

TABLE 8

Means and Std Deviations

| Sample | # of Tests | Mean | Std Dev | Std Err Mean | Lower 95% | Upper 95% |
|---|---|---|---|---|---|---|
| A | 18 | 77.439 | 9.1975 | 2.1679 | 73.16 | 81.72 |
| B | 18 | 86.483 | 9.2859 | 2.1887 | 82.16 | 90.81 |
| C | 18 | 104.133 | 10.2794 | 2.4229 | 99.35 | 108.92 |
| D | 18 | 126.806 | 5.9801 | 1.4095 | 124.02 | 129.59 |
| E | 18 | 126.700 | 5.5138 | 1.2996 | 124.13 | 129.27 |
| F | 18 | 127.678 | 4.2142 | 0.9933 | 125.72 | 129.64 |

TABLE 8-continued

Means and Std Deviations

| Sample | # of Tests | Mean | Std Dev | Std Err Mean | Lower 95% | Upper 95% |
|---|---|---|---|---|---|---|
| G | 18 | 122.983 | 4.8834 | 1.1510 | 120.71 | 125.26 |
| H | 33 | 123.100 | 6.4206 | 1.1177 | 120.89 | 125.31 |

The FIGURE is a one-way ANOVA analysis of composite strength for each of the samples A through H. Table 8 demonstrates the means and standard deviations. The standard error uses a pooled estimate of error variance. As can be seen, the composite strength for each of sample B through H (each reinforced with mineral wool, in accordance with an embodiment of the present invention) is significantly better than that of the non-reinforced sample A.

Example 3

Example 3, which includes Tables 9 and 10, demonstrates grinding performance as a function of mix quality. As can be seen in Table 9, components of two sample formulations are provided (in vol %). The formulations are identical, except that Formulation 1 was mixed for 45 minutes and Formulation 2 was mixed for 15 minutes (the mixing method used was identical as well, except for the mixing time as noted). Each formulation includes Sloss PMF® mineral wool, in accordance with one embodiment of the present invention. Other types of single filament microfiber (e.g., glass or ceramic fiber) may be used as well, as previously described.

TABLE 9

Grinding Performance as a Function of Mix Quality

| Sequence | Component | Formulation 1 (vol %) | Formulation 2 (vol %) |
|---|---|---|---|
| Step 1: Bond preparation | Durez 29722 | 22.38 | 22.38 |
| | Brown Fused Alumina-220 grit | 3.22 | 3.22 |
| | Sloss PMF ® | 3.22 | 3.22 |
| | Iron Pyrite | 5.06 | 5.06 |
| | Zinc Sulfide | 1.19 | 1.19 |
| | Cryolite | 3.28 | 3.28 |
| | Lime | 1.19 | 1.19 |
| | Tridecyl alcohol | 1.11 | 1.11 |
| Step 2: Mixing | | 45 minutes | 15 minutes |
| Bond Quality Assessment | Wt % of un-dispersed mineral wool from Rototap method | 1.52 | 2.36 |
| Step 3: Composite Preparation | Abrasive | 48 | 48 |
| | Varcum 94-906 | 4.37 | 4.37 |
| | Furfural | 1 wt % of total abrasive | |
| Step 4: Mold filing & cold Pressing | Porosity target | 8% | 8% |
| Step 5: Curing | | 30 hr ramp to 175° C. followed by 17 Hr soak at 175° C. | |

As can also be seen from Table 9, the manufacturing sequence of a microfiber reinforced abrasive composite configured in accordance with one embodiment of the presents invention includes five steps: bond preparation; mixing, composite preparation; mold filling and cold pressing; and curing. A bond quality assessment was made after the bond preparation and mixing steps. As previously discussed, one way to assess the bond quality is to perform a dispersion test to determine the weight percent of un-dispersed mineral wool from the Rototap method. In this particular case, the Rototap method included adding 50 g-100 g of bond sample to a 40 mesh screen and then measuring the amount of residue on the 40 mesh screen after 5 minutes of Rototap agitation. The abrasive used in both formulations at Step 3 was extruded bauxite (16 grit). The brown fused alumina (220 grit) is used as a filler in the bond preparation of Step 1, but may operate as a secondary abrasive as previously explained. Note that the Varcum 94-906 is a Furfurol-based resole available from Durez Corporation.

Table 10 demonstrates the grinding performance of reinforced grinding wheels made from both Formulation 1 and Formulation 2, at various cutting-rates, including 0.75, 1.0, and 1.2 sec/cut.

TABLE 10

Demonstrates the Grinding Performance

| Formulation | Cut Rate (sec/cut) | MRR ($in^3$/min) | WWR ($in^3$/min) | G-Ratio |
|---|---|---|---|---|
| Formulation 1 | 0.75 | 31.53 | 4.35 | 6.37 |
| Formulation 1 | 1.0 | 23.54 | 3.29 | 7.15 |
| Formulation 1 | 1.2 | 19.97 | 2.62 | 7.63 |
| Formulation 2 | 0.75 | 31.67 | 7.42 | 4.27 |
| Formulation 2 | 1.0 | 23.75 | 4.96 | 4.79 |
| Formulation 2 | 1.2 | 19.88 | 3.64 | 5.47 |

As can be seen, the material removal rates (MRR), which is measured in cubic inches per minute, of Formulation 1 was relatively similar to that of Formulation 2. However, the wheel wear rate (WWR), which is measured in cubic inches per minute, of Formulation 1 is consistently lower than that of Formulation 2. Further note that the G-ratio, which is computed by dividing MRR by WWR, of Formulation 1 is consistently higher than that of Formulation 2. Recall from Table 9 that the example bond of Formulation 1 was mixed for 45 minutes, and Formulation 2 was mixed 15 minutes. Thus, mix time has a direct correlation to grinding performance. In this particular example, the 15 minute mix time used for Formulation 2 was effectively too short when compared to the improved performance of Formulation 1 and its 45 minute mix time.

Example 4

Example 4, which includes Tables 11, 12, and 13, demonstrates grinding performance as a function of active fillers with and without mineral wool. As can be seen in Table 11, components of four sample composites are provided (in vol %). The composite samples A and B are identical, except that sample A includes chopped strand fiber, and no brown fused alumina (220 Grit) or Sloss PMF® mineral wool. Sample B, on the other hand, includes Sloss PMF® mineral wool and brown fused alumina (220 Grit), and no chopped strand fiber. The composite density (which is measured in grams per cubic centimeter) is slightly higher for sample B relative to sample A. The composite samples C and D are identical, except that sample C includes chopped strand fiber and no Sloss PMF® mineral wool. Sample D, on the other hand, includes Sloss PMF® mineral wool and no chopped strand fiber. The composite density is slightly higher for sample C relative to sample D. In addition, a small but sufficient amount of furfural (about 1 vol % or less of total abrasive) was used to wet the abrasive particles, which in this case were alumina grains for samples C and D and alumina-zirconia grains for samples A and B.

TABLE 11

Grinding performance as a Function of Active Fillers

| | Composite Content (vol %) | | | |
|---|---|---|---|---|
| Component | A | B | C | D |
| Alumina Grain | 0.00 | 0.00 | 52.00 | 52.00 |
| Alumina-Zirconia Grain | 54.00 | 54.00 | 0.00 | 0.00 |
| Durez 29722 | 20.52 | 20.52 | 19.68 | 19.68 |
| Iron Pyrite | 7.20 | 7.20 | 8.36 | 8.36 |
| Potassium Sulfate | 0.00 | 0.00 | 3.42 | 3.42 |
| Potassium Chloride/ Sulfate (60:40 blend) | 3.60 | 3.60 | 0.00 | 0.00 |
| MKC-S | 3.24 | 3.24 | 3.42 | 3.42 |
| Lime | 1.44 | 1.44 | 1.52 | 1.52 |
| Brown Fused Alumina - 220 Grit | 0.00 | 3.52 | 0.00 | 0.00 |
| Porosity | 2.00 | 2.00 | 2.00 | 2.00 |
| Sloss PMF | 0.00 | 8.00 | 0.00 | 8.00 |
| Chop Strand Fiber | 8.00 | 0.00 | 8.00 | 0.00 |
| Furfural | 1 wt % of total abrasive | | | |
| Density (g/cc) | 3.07 | 3.29 | 3.09 | 3.06 |
| Wheel Dimensions (mm) | 760 × 76 × 203 | 760 × 76 × 203 | 610 × 63 × 203 | 610 × 63 × 203 |

Table 12 demonstrates tests conducted to compare the grinding performance between the samples B and D, both of which were made with a mixture of mineral wool and the example active filler manganese dichloride (MKC-S, available from Washington Mills), and samples A and C, which were made with chopped strand instead of mineral wool.

TABLE 12

| Demonstrates the Grinding Performance | | | | | | |
|---|---|---|---|---|---|---|
| Test Number | Sample | Slab Material | MRR (kg/hr) | WWR (dm3/hr) | G-ratio (kg/dm3) | Percentage Improvement |
| 1 | A | Austenitic | 193.8 | 0.99 | 196 | 27.77% |
| | B | Stainless Steel | 222.6 | 0.89 | 250 | |
| 2 | A | Ferritic | 210 | 1.74 | 121 | 27.03% |
| | B | Stainless Steel | 208.5 | 1.36 | 153 | |
| 3 | C | Austenitic | 833.1 | 4.08 | 204 | 35.78% |
| | D | Stainless Steel | 808.8 | 2.92 | 277 | |
| 4 | C | Carbon | 812.4 | 2.75 | 296 | 30.07% |
| | D | Steel | 784.1 | 2.03 | 385 | |

As can be seen, grinding wheels made from each sample were used to grind various workpieces, referred to as slabs. In more detail, samples A and B were tested on slabs made from austenitic stainless steel and ferritic stainless steel, and samples C and D were tested on slabs made from austenitic stainless steel and carbon steel. As can further be seen in Table 12, using a mixture of mineral wool and manganese dichloride samples B and D provided about a 27% to 36% improvement relative to samples A and C (made with chopped strand instead of mineral wool). This clearly shows improvements in grinding performance due to a positive reaction between mineral wool and the filler (in this case, manganese dichloride). No such positive reaction occurred with the chopped strand and manganese dichloride combination. Table 13 lists the conditions under which the composites A through D were tested.

TABLE 13

| Demonstrates Grinding Conditions | | | |
|---|---|---|---|
| Test Number | Grinding Power (kw) | Slab Material | Slab Condition |
| 1 | First path at 120 and followed by 85 | Austenitic Stainless Steel | Cold |
| 2 | First path at 120 and followed by 85 | Ferritic Stainless Steel | Cold |
| 3 | 105 | Austenitic Stainless Steel | Hot |
| 4 | 105 | Carbon Steel | Hot |

The foregoing description of the embodiments of the invention has been presented for the purposes of illustration and description. It is not intended to be exhaustive or to limit the invention to the precise form disclosed. Many modifications and variations are possible in light of this disclosure. It is intended that the scope of the invention be limited not by this detailed description, but rather by the claims appended hereto.

What is claimed is:

1. A composition, comprising:

an organic bond material;

an abrasive material, dispersed in the organic bond material;

a plurality of mineral wool micro fibers that are uniformly dispersed in the organic bond material, wherein said microfibers are individual filaments having an average length of less than about 1000 μm; and an active filler comprising manganese dichloride.

2. The composition of claim 1 wherein the organic bond material is one of a thermosetting resin, a thermoplastic resin, or a rubber.

3. The composition of claim 1 wherein the organic bond material is a phenolic resin.

4. The composition of claim 1 wherein the microfibers have an average length in the range of about 100 to 500 μm and a diameter less than about 10 microns.

5. The composition of claim 1 wherein the mineral wool fibers are made from minerals or metal oxides.

6. The composition of claim 1 wherein the composition includes:

from 10% by volume to 50% by volume of the organic bond material;

from 30% by volume to 65% by volume of the abrasive material; and from 1% by volume to 20% by volume of the micro fibers.

7. The composition of claim 1 wherein the composition includes:

from 25% by volume to 40% by volume of the organic bond material;

from 50% by volume to 60% by volume of the abrasive material; and from 2% by volume to 10% by volume of the micro fibers.

8. The composition of claim 1 wherein the composition includes:

from 30% by volume to 40% by volume of the organic bond material;

from 50% by volume to 60% by volume of the abrasive material; and from 3% by volume to 8% by volume of the micro fibers.

9. The composition of claim 1 wherein the composition is in the form of an abrasive article used in abrasive processing of a workpiece.

10. The composition of claim 9 wherein the abrasive article is a wheel.

11. An abrasive article, comprising:

an organic bond material including one of a thermosetting resin, a thermoplastic resin, or a rubber;

an abrasive material, dispersed in the organic bond material; and a plurality of mineral wool micro fibers that are uniformly dispersed in the organic bond material, wherein said microfibers are individual filaments having an average length of less than about 1000 μm and a diameter less than about 10 microns; and an active filler comprising manganese dichloride; and wherein the abrasive article includes from 10% by volume to 50% by volume of the organic bond material, from 30% by volume to 65% by volume of the abrasive material, and from 1% by volume to 20% by volume of the micro fibers.

12. The composition of claim 11 wherein the mineral wool fibers are made from minerals or metal oxides.

13. A method of abrasive processing a workpiece, the method comprising:

mounting the workpiece onto a machine capable of facilitating abrasive processing;

operatively coupling an abrasive article to the machine, the abrasive article comprising an organic bond material;

an abrasive material, dispersed in the organic bond material;

a plurality of mineral wool micro fibers that are uniformly dispersed in the organic bond material, wherein said microfibers are individual filaments having an average length of less than about 1000 μm;

an active filler comprising manganese dichloride; and contacting the abrasive article to a surface of the workpiece.

14. The method of claim 13 wherein the mineral wool fibers are made from minerals or metal oxides.

15. The composition of claim 1, wherein the microfibers have an average diameter of 4 to 6 microns.

16. The composition of claim 1, further comprising iron pyrite, lime, potassium sulfate, potassium chloride, or any combination thereof.

* * * * *